United States Patent [19]

Bridges, Sr.

[11] 4,359,965

[45] Nov. 23, 1982

[54] SEALANT APPLICATOR

[75] Inventor: Thomas N. Bridges, Sr., Marietta, Ga.

[73] Assignee: Lockheed Corporation, Burbank, Calif.

[21] Appl. No.: 292,649

[22] Filed: Aug. 13, 1981

[51] Int. Cl.[3] ..... B05C 9/02

[52] U.S. Cl. ..... 118/711; 118/410

[58] Field of Search ..... 118/710, 711, 410

[56] References Cited

U.S. PATENT DOCUMENTS 2,345,534 3/1944 Grim ..... 118/710

3,889,628 6/1975 Usab ..... 118/711

*Primary Examiner*—John P. McIntosh

*Attorney, Agent, or Firm*—Albert L. Carter

[57] ABSTRACT

A sealant applicator assembly (10) for mounting to an automatic drilling and fastener installation machine to apply sealant to the tip or shank surface of a fastener (14) before "wet" installation of the fastener into a hole. The assembly (10) includes a valve member (21) that is opened or actuated by physical movement of the fastener (14) therewith whereby sealant flows into contact with the fastener shank. Upon removal of the fastener (14) from contact with the valve members (21), valve closure takes place due to sealant pressure and sealant flow is stopped. By sequencing the sealant application onto the fastener concurrently with drilling or other hole preparation by the automatic machine, cycle time for "wet" fastener installation is minimized.

4 Claims, 5 Drawing Figures

SEALANT APPLICATOR

TECHNICAL FIELD

This invention pertains to a liquid or sealant applicator for use on automatic drilling and fastener installation machines, and more particularly to an apparatus for applying a liquid or sealant to the axial side surface or tip of a fastener before installation thereof.

BACKGROUND ART

With the advent of "wet" installation of fasteners such as bolts, rivets, etc. into drilled holes whereby a semi-liquid or viscous material such as a corrosion inhibiting solution or a sealant is placed between the confronting surfaces of the fastener and sidewall of the hole or opening, and the combination of such practice with the available and known automatic drilling and fastener installation macines, most of the prior art devices involve the concept of placing such liquid or sealant in the hole or on the sidewall thereof before fastener installation as shown in my prior U.S. Pat. No. 3,350,774 issued Nov. 7, 1967 and the Douglas U.S. Pat. No. 3,379,167, issued Apr. 23, 1968.

Notwithstanding such combination of the principle of "wet" fastener installation with either the specialized drilling equipment as in the Douglas Patent or the automatic drilling and installation equipment as shown in my prior patent, such combinations have limitations. For example, with the Douglas arrangement in FIGS. 9 and 10, there is an inherent limitation in that the hole pattern must be linearly and uniformly spaced. Similarly, in my prior cited patent, there is an inherent prolongation or delay in the machine cycle time in that after completion of the hole drilling operation, insertion of the fastener must await application of the sealant in the hole and thereby ceates a delay in the machine cycle time.

DISCLOSURE OF THE INVENTION

This invention provides an apparatus for mounting on an automatic fastener installation machine whereby a protective fluid or sealant material is deposited directly on the tip or shank portion of a fastener before insertion of the fastener into a pre-drilled hole to receive the fastener. Such deposition on the fastener can be accomplished in a simultaneous manner while the hole preparation is still underway whereby no delay in machine cycle time due to awaiting sealant application to the fastener need occur.

In addition, other objects and advantages are presented with this apparatus in that a uniform coating of sealant is applied on fasteners, including threaded portions when present; there are few moving parts with no cam or bar linkages whereby more precise sealant supply control is easily accomplished; and, the sealant applying member is easy to clean and easily exchanged to accommodate various fastener sizes.

DETAILED DESCRIPTION

Figure 1:
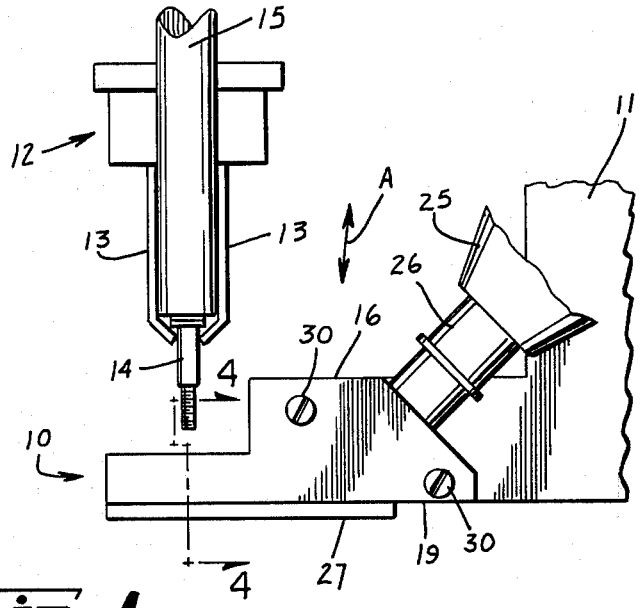
FIG. 1 shows the relative physical locations of the preferred embodiment apparatus of this invention and a typical fastener holding and installation member of an automatic fastener installation machine.

Referring to FIG. 1, the preferred embodiment of this invention comprises a sealant applicator assembly 10 connected to a movable mount 11 such as can be located on an automatic fastener installation machine (not shown). Such mount 11 is movable relative to an appropriate fastener gripping and installation driving mechanism 12 shown consisting of fingers 13 gripping a threaded fastener 14 with the head of said fastener located in abutment with fastener installing or driving ram 15. The mount 11 and mechanism 12 as shown are representative of segments of an automatic fastener installation machine and are individually and selectively movable in any combination of X, Y or Z-axis directions; all of which form no part of this invention other than the requirement that there be some relative vertical movement between mount 11 and mechanism 12 as represented by the bi-directional arrow A and discussed in the explanation of operation of the invention hereinafter.

Referring now to FIGS. 2 through 5, the assembly 10 comprises a body 16 having a vertical passage 17 and a fluid or sealant supply passage 18 extending to the bottom 19 of body 16. The bottom of vertical passage 17 is countersunk to form a truncated conical surface 20.

A valve body or sealant dispensing tip 21 of a substantially calathiform shape with an enlarged base portion 22 is inserted into passage 17 and is diametrically sized along the main tubular portion 23 to permit a slideable engagement with the sidewall of passage 17. The diameter of base portion 22 is sized to seat on surface 20 when tip 21 is inserted into passage 17 the maximum amount possible.

A plurality of holes 24 extend radially through the sidewall of tip 21 for communication between the interior and exterior of tip 21 proximate the base portion 22.

As shown, the end of body 16 containing passage 17 is of a reduced height as compared to the central portion of body 16. Such height reduction or offset is variable and is provided, when appropriate, to prevent any interference between the fastener gripping mechanism 12 and body 16 when the fastener 14 is placed within tip 21 for sealant application as explained below in the operation of the invention. Likewise, the overall height of tip 21 is selectively variable depending upon the length and extent of the fastener 14 on which sealant is to be applied.

A pressurized liquid or sealant supply 25 is connected to body 16 at the upper end of passage 18 by an appropriate tubing member 26; the purpose and function of supply 25 being discussed in more detail hereinafter. The angularity of passage 18 and sealant supply 25 relative to body 16 is of an appropriate degree and orientation so as to avoid any interference between the sealant supply 25 and the existing structure or mechanisms of the machine the assembly 10 is to be mounted on.

Figure 2:
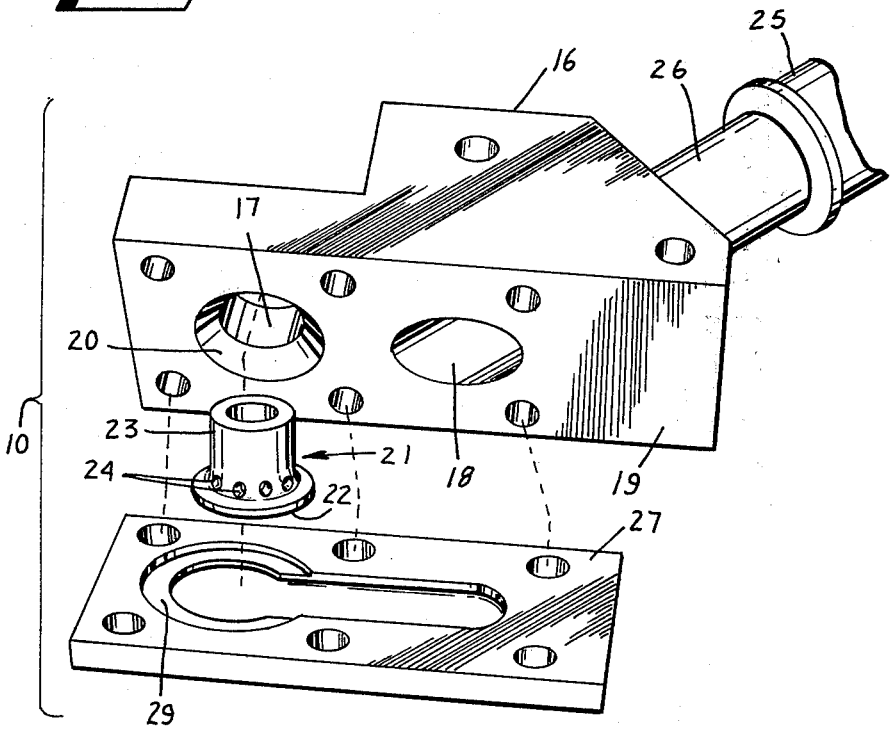
FIG. 2 is an exploded view of the preferred embodiment of this invention.

A closure or base member 27 is secured to the bottom 19 of body 16 by appropriate fastening devices such as screws (not shown). The surface of member 27 confronting bottom 19 of body 16 when assembled thereto contains a channel arrangement 28 as best seen in FIG. 2. Channel 28 consists of an oval slot enlarged at one end to form in plan view the appearance of a key-hole configuration. The enlarged end of channel 28 is further enlarged to provide a semi-annular step or ledge 29.

Figure 3:
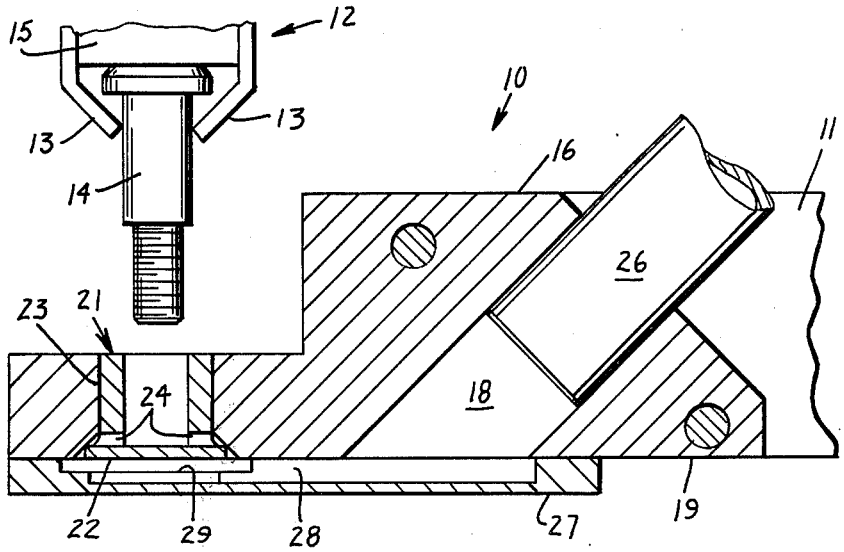
FIG. 3 is similar to FIG. 1 with the preferred apparatus of this invention shown in cross-section.
Figure 4:
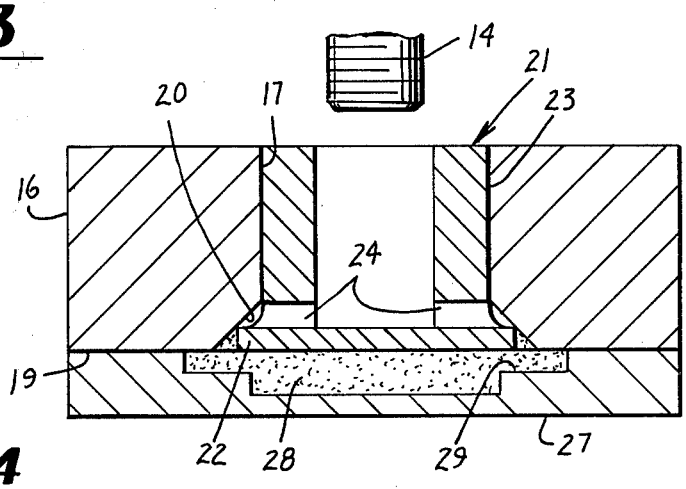
FIG. 4 is a view taken along lines 4—4 of FIG. 1.
Figure 5:
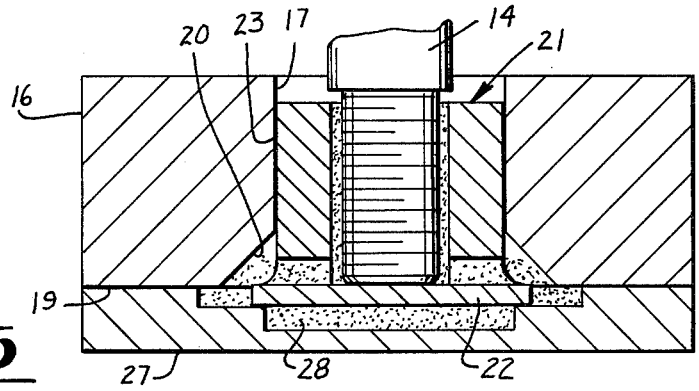
FIG. 5 is a view similar to FIG. 4 with the fastener located within the apparatus of this invention during application of sealant to the fastener.

The extent of channel 28 enlargements are such that the smaller one is less than the diameter of the base portion 22 of valve body or tip 21 as best seen in FIGS. 3, 4 and 5, and the larger one is greater than the diameter of said base portion 22 as likewise seen in FIGS. 3, 4 and 5.

As is also apparent in FIGS. 3, 4 and 5, the diameter of the internal, axially extending passage in tip 21 is sufficiently greater than the shank diameter of fastener 14 so as to permit an annular passage between the inner sidewall of tip 21 and shank surface of fastener 14 when fastener 14 is placed in and activates tip 21 to permit the flow of fluid or sealant between these confronting surfaces as set forth below in the operation description of this invention.

OPERATION OF THE INVENTION

Assembly 10 is connected to machine mount 11 by screw or other appropriate connecting means 30 as seen in FIG. 1, and the sealant supply 25 is appropriately connected to body 16 whereby sealant from supply 25, under pressure, flows through passage 18 into channel 28 and causes the valve body or tip 21 to move upwardly into passage 17 as shown in FIGS. 3 and 4 by which sealant flow through holes 24 into the interior of tip 21 is prevented due to the sealing action of base portion 22 held in contact with the chamfered surface 20 of passage 17.

As the fastener installation mechanism 12 and mount 11 are moved relatively toward each other so that the fastener 14 is aligned with the interior of tip 21, the final action for application of sealant to fastener 14 is accomplished by a relative vertical motion between mount 11 and mechanism 12 toward each other as represented by arrow A in FIG. 1. Such relative vertical motion places the tip end of fastener 14 onto the bottom of the interior of valve body or tip 21 forcing the tip 21 down in passage 17 until bases 22 rests on step or ledge 29 as seen in FIG. 4 whereby the sealant flows from channel 28 through holes 24 into the annular space between the interior sidewall of tip 21 and the exterior surface of fastener 14 for coating contact therewith. After sealant is applied to the side of fastener 14, it is withdrawn from tip 21 and tip 21 is raised from the position in FIG. 4 to the closed position of FIG. 3 by the pressure of sealant in channel 28 reacting on the bottom of base 22 of tip 21 whereby the assembly 10 can await insertion of the next fastener for application of sealant thereto.

The coated fastener 14 is now ready to be carried by mechanism 12 for insertion into a fastener hole. Depending upon the thickness of the sealant coating, a portion of such will be wiped onto the uncoated portion of the fastener shank upon insertion into the hole, and if sufficient sealant has been applied by use of the invention, sealant may also be located under the head of the installed fastener.

The flow rate of the sealant is dependent upon such factors as viscosity of the sealant, pressure of supplied sealant, distance base 22 of tip 21 travels toward ledge 29, and the size and number of holes 24. As long as tip 21 is actuated and held away from conical surface 20, sealant will continue to flow; therefore, the quantity of sealant dispensed into the interior of tip 21 is varied or controlled by the time of depression or actuation of tip 21.

It is to be understood that the foregoing disclosure is illustrative of a preferred embodiment of the invention. Various changes and modifications to this embodiment will suggest themselves to those skilled in the art without departing from the true spirit and scope of the invention as set forth in the appended claims which alone define the true limitations of this invention.

What is claimed is:

1. A sealant applicator assembly for mounting on an automatic fastener installation machine including a movable fastener gripping and installation mechanism, said assembly comprising:

a body member having a bottom surface and at least one upper surface portion;

a first passage means in said body member that extends substantially vertically between said bottom surface and said upper surface portion;

a second passage means in said body member extending from said bottom surface to the exterior of said body member, said second passage means adapted to have a sealant supply connected thereto to deliver sealant to said second passage means;

the openings of said first and second passage means in the bottom surface of said body member being spaced whereby a portion of the bottom surface is located between the openings therein;

a base plate means mounted to the bottom surface of the body member, the area of the body member bottom surface confronted by said base plate means encompassing no less than the openings of the first and second passage means and the bottom surface portion therebetween;

a valve means located within said first passage means which is actuable by the tip of the shank end of a fastener held by said fastener gripping and installation mechanism being forcibly inserted into said first passage means from the upper surface portion of the body member;

and a third passage means in said assembly interconnecting said first and second passage means whereby sealant may flow from the sealant supply to the fastener shank located in the first passage means when the valve means has been opened thereby.

2. A sealant applicator assembly as claimed in claim 1 wherein said valve means comprises a calathiform member having a plurality of sidewall openings therethrough and adapted to have limited vertical slideability in said first passage means whereby when said valve means is depressed by a fastener, the sealant can flow from said third passage means through said sidewall openings into the interior of said calathiform member for contact with the fastener shank, and upon removal of the fastener from contact with the valve means the valve means is moved vertically upward to a closed position by the pressure of the sealant.

3. A sealant applicator assembly as claimed in claim 2 wherein the portion of the first passage means at the bottom surface of the body member is chamfered to provide a truncated conical surface, and the calathiform member valve means has an enlarged base portion proximate the lower end thereof and sized to prevent passage past the truncated conical surface whereby the upward displacement of the valve means in the first passage means by the pressure of the sealant is limited upon removal of a fastener from contact with the valve means.

4. A sealant applicator as claimed in claim 1 wherein the third passage means is a channel formed in the surface of the base plate means confronting the body member bottom suface.

* * * * *